US005561034A

United States Patent [19]

Desie et al.

[11] Patent Number: 5,561,034

[45] Date of Patent: Oct. 1, 1996

[54] CORE-SHELL LATEX FOR USE IN PHOTOGRAPHIC MATERIALS

[75] Inventors: Guido Desie, Herent, Belgium; Michael Müller, Bergisch Gladbach, Germany; Stefaan Lingier, Assenede, Belgium

[73] Assignee: Agfa-Gevaert, N.V., Mortsel, Belgium

[21] Appl. No.: 503,001

[22] Filed: Jul. 17, 1995

[30] Foreign Application Priority Data

Aug. 30, 1994 [EP] European Pat. Off. ..... 94202476

[51] Int. Cl.[6] ..... G03C 1/76

[52] U.S. Cl. ..... 430/536; 430/523; 430/531; 430/533; 430/534; 430/535; 430/537; 430/627; 430/961

[58] Field of Search ..... 430/523, 531, 430/533, 534, 535, 536, 537, 627, 961

[56] References Cited

U.S. PATENT DOCUMENTS 4,977,071 12/1990 Kanetake et al. ..... 430/537
5,066,572 11/1991 O'Connor et al. ..... 430/537

OTHER PUBLICATIONS

Hatakeyama et al., United States Statutory Invention Registration, Reg. No. H1016, Jan.–1992.

*Primary Examiner*—Geraldine Letscher
*Attorney, Agent, or Firm*—Breiner & Breiner

[57] ABSTRACT

A photographic material is provided comprising a support, a subbing layer, at least one hydrophilic gelatinous silver halide emulsion layer, optionally one or more other hydrophilic gelatinous layer(s) and a core-shell latex polymer, comprising a core (co)polymer and a shell (co)polymer characterized in that (i) said core-shell latex is present in at least one of said hydrophilic gelatinous layers, (ii) said shell (co)polymer comprises moieties A derived from at least one ethylenically unsaturated monomer having a reactive methylene group and (iii) said moieties A present in said shell (co)polymer make up between 1 and 30% by weight of all moieties present in both said core and said shell (co)polymer and (iv) said moieties A present in said shell (co)polymer make up between 2 and 50% of all moieties present in said shell (co)polymer.

The material shows both high dimensional stability and high scratch resistance.

12 Claims, No Drawings

CORE-SHELL LATEX FOR USE IN PHOTOGRAPHIC MATERIALS

DESCRIPTION

1. Field of the Invention

The present invention relates to new types of polymeric latices and their use in photographic materials.

2. Background of the Invention

Coated photographic layers and complete photographic materials must comply with a number of requirements concerning physical properties. In order to avoid physical damage during manufacturing and handling a photographic material must show a sufficiently high scratch resistance. Furtheron, photographic materials must show a good flexibility so that easy handling without the occurence of creases or cracks is possible; in other words, the materials may not suffer from brittleness especially under critical low humidity conditions. On the other hand, stickiness should be avoided. Still furtheron, photographic materials must show a good dimensional stability, meaning a minimal dimensional distortion during processing especially during the drying phase at elevated temperature. The requirement of dimensional stability is particularly stringent for graphic arts contact materials often serving in pre-press activity as final intermediates between colour separations produced on a scanner and the exposure step onto a printing plate. Several contacts, being duplicates of different separations, have to be exposed in register on one and the same printing plate and mutually different dimensional distorsions would lead to unacceptable colour shifts on image edges in the final print.

As well known in the art flexibility and dimensional stability can be improved by the incorporation of so-called plasticizers. These substances can be relatively low-molecular weight compounds, preferably containing several hydrophilic groups like hydroxyl groups, or they can be polymer latices preferably having a rather low glass transition temperature. The former are able to reduce the Tg (glass transition temperature) of the binder system itself, while the latter (the polymeric latices) result in a 2-component system with a Tg typical for the binder and a second Tg typical for the latex. In both ways the layer is kept sufficiently flexible at room temperature, even at a high hardening degree of the gelatinous layer while the required dimensional stability is assured.

Representative plasticizers include alcohols, dihydric alcohols, trihydric alcohols and polyhydric alcohols, acid amides, cellulose derivatives, lipophilic couplers, esters, phosphate esters such as tricresyl phosphate, glycol esters, diethylene glycol mixed esters, phthalate esters such as dibutyl phthalate and butyl stearate, tetraethylene glycol dimethyl ether, ethyl acetate copolymers, lactams, lower alkyl esters of ethylene bis-glycolic acid, esters or diesters of an alkylene glycol or a polyalkylene glycol, polyacrylic acid esters, polyethylene imines, poly(vinyl acetate) and polyurethanes, as illustrated by Eastman et al U.S. Pat. No. 306,470, Wiest U.S. Pat. No. 3,635,853, Milton et al U.S. Pat. No. 2,960,505, Faber et al U.S. Pat. No. 3,412,159, Ishihara et al U.S. Pat. No. 3,640,721, Illingsworth et al U.S. Pat. No. 3,0003,878, Lowe et al U.S. Pat. No. 2,327,808, Urnberger U.S. Pat. No. 3,361,565, Gray U.S. Pat. No. 2,865,792, Milton U.S. Pat. Nos. 2,904,434 and 2,860,980, Milton et al U.S. Pat. No. 3,033,680, Dersch et al U.S. Pat. No. 3,173,790, Fowler U.S. Pat. No. 2,772,166 and Fowler et al U.S. Pat. No. 2,835,582, Van Paesschen et al U.S. Pat. No. 3,397,988, Balle et al U.S. Pat. No. 3,791,857, Jones et al U.S. Pat. No. 2,759,821, Ream et al U.S. Pat. No. 3,287,289 and De Winter et al U.S. Pat. No. 4,245,036.

Low-molecular plasticizers with hydrophilic groups show the disadvantage of rendering the coated hydrophilic layer(s) of a photographic element sticky particularly at elevated relative humidity. When photographic materials are packaged, stored and delivered in a web-like or sheet-like manner an unacceptable adherance of support parts to surface parts can occur during storage or after processing. Moreover, they are not diffusion resistant. On the other hand, plasticizers consisting of conventional polymer latices, e.g. polyethylacrylates and analogues which are widely used in commercial materials, show other drawbacks. The amount of latex which can be incorporated in a gelatinous layer in order to improve dimensional stability is limited because high concentrations of the latex disturb the cohesion of the gelatine matrix resulting in a decrease of the scratch resistance eventually below a critical level.

So there is a need for new types of latices which can be incorporated in gelatinous layers at higher latex/gelatin ratios (up to 1:1 ratio's) without affecting the scratch resistance too strongly. Attempts to provide latices giving improved physical properties are disclosed in, e.g. EP 0 477 670, which describes the use of gelatin-grafted latices, in WO19/14968, which discloses reduced pressure fog with uncase-hardened and case-hardened gelatine-grafted polymer latices, and in EP 0 219 101 which discloses incorporation of high quantities of hydrophobic latices by surrounding them during preparation with natural water-soluble polymers like dextranes. U.S. Pat. No. 4,714,671 discloses polymer latices in which the dispersed particles consist of a soft hydrophobic core and a hard shell giving rise to suitable plasticizers which do not diffuse out of the layer under tropical conditions.

In EP 107 378 a hydrophobic core-shell latex comprising a hard core with Tg>70° C. and a soft shell (Tg from 25° to 60° C.), wherein the core represents at least 80% by weight of the total polymer content of the latex particles, is described. Such water dispersable latices form easily a continuous film of a polymer on any possible support. It is disclosed that the use of such core-shell latices as overcoat in photographic materials reduces the ferrotyping, i.e. reduces antistatic discharges.

Polymeric, non-core-shell, latices have been used to provide good dimensional stability and good resistance to scratchability. In e.g. U.S. Pat. No. 3,459,790 it has been disclosed that the incorporation of 0.1% by weight (with respect to the total weight of the monomers present) of a monomer comprising a reactive methylene group into the bulk of the latex particles would yield latices that, when added to a photogrphic material, would both improve dimensional stability and resistance against scratches.

In EP-A 343 642 and US-H H1016 the use of a vinylidenechloride copolymer, being a core-shell latex comprising reactive methylene groups in a subbing layer is disclosed. The use of said subbing layer enhances the dimensional stability of photographic silver halide materials coated onto a support comprising said said polymer in said subbing layer.

The present invention extends the teachings on improved polymer latices for use as plasticizers in photographic materials.

OBJECTS AND SUMMARY OF THE INVENTION

It is an object of the present invention to provide new types of latices which can be incorporated in gelatinous layers in high concentrations while retaining good scratch resistance.

It is a further object of the present invention to provide improved photographic materials showing a favourable compromise between dimensional stability, flexibility and scratch resistance.

It is a further object of the invention to provide improved photographic materials showing a favourable compromise between dimensional stability, flexibility and scratch resistance while keeping a low water absorption.

It is a further object of the invention to provide latices, useful to prepare photographic materials exhibiting the properties above, that are cheaper and more stable.

Other objects of the invention will become apparent from the description hereafter.

The objects of the invention are realized by providing a photographic material comprising a support, a subbing layer, at least one hydrophilic gelatinous silver halide emulsion layer, optionally one or more other hydrophilic gelatinous layer(s) and a core-shell latex polymer, comprising a core (co)polymer and a shell (co)polymer characterised in that (i) said core-shell latex is present in at least one of said hydrophilic gelatinous layers, (ii) said shell (co)polymer comprises moieties A derived from at least one ethylenically unsaturated monomer having a reactive methylene group and (iii) said moieties A present in said shell (co)polymer make up between 1 and 30% by weight of all moieties present in both said core and said shell (co)polymer and (iv) said moieties A present in said shell (co)polymer make up between 2 and 50% of all moieties present in said shell (co)polymer.

In a preferred embodiment, said moieties A present in said shell (co)polymer make up between 1 and 15% by weight of all moieties present in both said core and said shell (co)polymer and said moieties A present in said shell (co)polymer make up between 2 and 20% of all moieties present in said shell (co)polymer.

DETAILED DESCRIPTION OF THE INVENTION

It has been found that silver halide photographic materials, comprising in one or more hydrophilic gelatinous layers a latex (co)polymer of the core-shell type comprising a (co)polymer prepared by the polymerization of at least one ethylenically unsaturated monomer, forming a core and a (co)polymer prepared by the polymerization of at least one ethylenically unsaturated monomer comprising a reactive —$CH_2$—group and optionally one or more other copolymerizable monomer(s) forming the shell, showed favourable physical properties and combined high resistance to scratches with high dimensional stability. It was also found that such material could comprise up to 50% by weight with respect to the hydrophilic binder (e.g. gelatin) in one or more hydrophilic layer without (substantially) increasing the water absorption of the material. Low water absorption is a must for silver halide materials intended for rapid processing. The speed limiting step in rapid processing is, in most of the cases, the drying step (following a development and fixing step) in which the water absorbed in the silver halide photographic material has to be evaporated. Since the invention latices do not (substantially) increase the water absorption, the invention latices can be used in high amounts even in materials intented for rapid processing.

It was found that the best results were obtained when a core-shell latex is used wherein the core (co)polymer and the shell (co)polymer are different and said at least one ethylenically unsaturated monomer comprising a reactive —$CH_2$—group is comprised in the shell (co)polymer. It is further preferred that 2 to 50% by weight, of said shell (co)polymer is represented by moieties A derived from said ethylenically unsaturated monomer comprising a reactive —$CH_2$—group. Said moieties A are preferably present in said shell (co)polymer in an amount between 1 and 30% by weight of all moieties present both in said core and said shell (co)polymer. It is most preferred that said moieties A, derived from unsaturated monomers comprsing a reactive —$CH_2$—group, are present in an amount between 1 and 15% by weight of all moieties present both in said core and said shell (co)polymer and said moieties A are present in said shell (co)polymer in an amount between 2 and 20% by weight of all moieties present in said shell (co)polymer.

Ethylenically unsaturated monomers comprising a reactive methylene (—$CH_2$—) group are monomers comprising a —$CH_2$—group localized between two strongly electron withdrawing groups. Typical examples of a —$CH_2$—group surrounded by strongly electron withdrawing groups are:

—CO —$CH_2$—CO—

—CO —$CH_2$—CN

—CO —$CH_2$—N— pyrazoles etc.

For use as ethylenically unsaturated monomer comprising a reactive —$CH_2$—group in the preparation of the shell of a core-shell latex according to the present invention, preferred monomers (hereinafter referred to as monomers of group A) are :

2-acetoacetoxyethylacrylate
2-cyano-N-2-propenylacetamide
5-hexene-2,4-dione
5-methyl-5-hexene-2,4-dione
2-methyl-2-propenoic acid 2-[(cyanoacetyl)-oxy]ethyl ester
2-acetoacetoxy-2,2-dimethylpropyl methacrylate
3-oxo-4-pentenoic acid, ethyl ester
3-oxo-butanoic acid, 2-[(2-methyl-1-oxo-2-propenyl)oxy] ethyl ester
2-acetoacetoxyethylmethacrylate
and diacetone acrylamide.

From the monomers recited above, the most preferred ones are:

2-acetoacetoxyethylmethacrylate
2-acetoacetoxy-2,2-dimethylpropyl methacrylate and
3-oxo-4-pentenoic acid, ethyl ester.

As monomer(s) useful to form either the core or the shell of the core-shell latices according to the present invention, (when used to form the shell of a core-shell latex according to this invention, these monomers are used in combination with monomer(s) from group A) are (meth)acrylic acid esters, mixtures of (meth)acrylic acid esters, other vinyl monomers and mixtures thereof (hereinafter referred to as monomers of group B). By the term (meth)acrylic acid esters, within the scope of the present invention are to be understood esters of methacrylic- and acrylic acid. Examples of useful monomers of group B, for use in the preparation of core-shell latices according to the present invention are:

2-Propenoic acid, methylester
2-Propenoic acid, pentyl ester
2-Propenoic acid, n-butyl ester
2-Propenoic acid, phenylmethyl ester
2-Propenoic acid, cyclohexyl ester 2-Propenoic acid, cyclopentyl ester
2-Propenoic acid, hexadecyl ester
2-Propenoic acid, 2-methylpropyl ester
2-Propenoic acid, 2-ethylhexyl ester
2-Propenoic acid, 2-(1-ethyl)pentyl ester
2-Propenoic acid, 2-(2-ethoxyethoxy)-ethyl ester
2-Propenoic acid, 2-butoxyethyl ester
2-Propenoic acid, 2-(2-methoxyethoxy)-ethyl ester
2-Propenoic acid, 2-n-propyl-3-i-propylpropyl ester 2-Propenoic acid, octyl ester
2-Propenoic acid, octadecyl ester
2-Propenoic acid, 2-ethoxyethyl ester
2-Propenoic acid, 2-methoxyethyl ester
2-Propenoic acid, 2-(methoxyethoxy)ethyl ester
2-Propenoic acid, ethyl ester
2-Propenoic acid, propyl ester
2-Propenoic acid, 2-phenoxyethyl ester
2-Propenoic acid, phenyl ester
2-Propenoic acid, 1-methylethyl ester
2-Propenoic acid, hexyl ester
2-Propenoic acid, 1-methylpropyl ester
2-Propenoic acid, 2,2-dimethylbutyl ester
(2-methyl-2)-propenoic acid, methylester
(2-methyl-2)-propenoic acid, pentyl ester
(2-methyl-2)-propenoic acid, n-butyl ester
(2-methyl-2)-propenoic acid, phenylmethyl ester
(2-methyl-2)-propenoic acid, cyclohexyl ester
(2-methyl-2)-propenoic acid, cyclopentyl ester
(2-methyl-2)-propenoic acid, hexadecyl ester
(2-methyl-2)-propenoic acid, 2-methylpropyl ester
(2-methyl-2)-propenoic acid, 2-ethylhexyl ester
(2-methyl-2)-propenoic acid, 2-(1-ethyl)pentyl ester
(2-methyl-2)-propenoic acid, 2-(2-ethoxyethoxy)-ethyl ester
(2-methyl-2)-propenoic acid, 2-butoxyethyl ester
(2-methyl-2)-propenoic acid, 2-(2-methoxyethoxy)-ethyl ester
(2-methyl-2)-propenoic acid, 2-n-propyl-3-i-propylpropyl ester
(2-methyl-2)-propenoic acid, octyl ester
(2-methyl-2)-propenoic acid, octadecyl ester
(2-methyl-2)-propenoic acid, 2-ethoxyethyl ester
(2-methyl-2)-propenoic acid, 2-methoxyethyl ester
(2-methyl-2)-propenoic acid, 2-(methoxyethoxy)ethyl ester
(2-methyl-2)-propenoic acid, ethyl ester
(2-methyl-2)-propenoic acid, propyl ester
(2-methyl-2)-propenoic acid, 2-phenoxyethyl ester
(2-methyl-2)-propenoic acid, phenyl ester
(2-methyl-2)-propenoic acid, 1-methylethyl ester
(2-methyl-2)-propenoic acid, hexyl ester
(2-methyl-2)-propenoic acid, 1-methylpropyl ester
(2-methyl-2)-propenoic acid, 2,2-dimethylbutyl ester
Allylmethacrylate
Tetraallyloxyethane
Acrylamide
Styrene
(1-Methylethenyl)benzene
3-Octadecyloxystyrene
4-Octadecyloxystyrene
N-(3-Hydroxyphenyl)-2-methyl-2-propenamide
2-Propenoic acid, 2-hydroxyethyl ester
2-Propenoic acid, 2-hydroxypropyl ester
(2-Methyl-2)-Propenoic acid, 2-hydroxyethyl ester
(2-Methyl-2)-Propenoic acid, 2-hydroxypropyl ester
N-(1-Methylethyl)-2-propenamide
3-Ethenylbenzoic acid
4-Ethenylbenzoic acid
N-(2-Hydroxypropyl)-2-methyl-2-propenamide
N,2-Dimethyl-2-propenamide
2-Methyl-2-propenamide
N-(2-Hydroxypropyl)-2-methyl-2-propenamide
N-[2-hydroxy-1,1-bis (hydroxymethyl)ethyl]-2-propenamide
N-(1,1-Dimethylethyl)-2-propenamide
Acetic acid ethenyl ester
3-Methylstyrene
4-Methylstyrene
N,N-dimethyl-2-propenamide
Ethyleneglycoldimethacrylate
Maleic acidanhydride, acetonitrile, vinylesters such as vinylacetate or vinylesters of branched chain carboxylic acids, e.g. LICAN 261, LICAN 270, LICAN 279, LICAN 288 or LICAN 245 (LICAN is a tradename from HUELS AG of Germany).

It is preferred, in the preparation of the core-shell latex of the present invention, to use monomers of group B either alone, or in combination with monomer(s) of group C (defined hereinafter) to prepare the core (co)polymer of the core-shell latex. Especially suited group B monomers are 2-propenoic acid methyl ester, 2-propenoic acid ethyl ester, 2-propenoic acid n-butyl ester, 2-methyl-2-propenoic acid methyl ester and styrene.

Further monomer(s) useful to from either the core or the shell of the core-shell latices according to the present invention, in combination with monomer(s) from group A and/or monomers of group B (to form the shell) or in combination of monomers of group B to form the core, are vinyl monomers that contain anionic groups, or form such groups depending on the pH of the polymerization mixture (herinafter referred to as monomers of group C).

Preference is given to vinyl monomers that contain carboxylate groups or sulphonate groups or that are capable of forming them by a variation of the pH. Examples of preferred vinyl monomers (group C) are:

1-Propene-1,2,3-tricarboxylic acid
2-Propenoic acid
2-Propenoic acid, sodium salt
2-Chloro-2-propenoic acid
2-Propenoic acid, 2-carboxyethyl ester
2-Methyl-2-propenoic acid
2-Methyl-2-propenoic acid, lithium salt
Methylenebutanedioic acid
2-Butenedioic acid
2-Methylbutenedioic acid
2-Methylenepentendioic acid
2-Carboethoxyallyl sulfate, sodium salt
2-Propenoic acid, ester with 4-hydroxy-1-butanesulphonic acid,
sodium salt
2-Propenoic acid, ester with 4-hydroxy-2-butanesulphonic acid,
sodium salt
3-Allyloxy-2-hydroxypropanesulphonic acid, sodium salt
2-Methyl-2-propenoic acid, ester with 3-[tert-butyl(2-hydroxyethyl)amino]propane sulphonic acid
Ethenesulphonic acid, sodium salt
Methylenesuccinic acid, diester with 3-hydroxy-1-propane sulphonic acid, disodium salt
2-Methyl-2-propenoic acid, ester with 2-(sulphooxy) ethyl, sodium salt
N-3-Sulphopropyl acrylamide, potassium salt
2-Methyl-2-propenoic acid, 2-sulphoethyl ester
2-Methyl-2-propenoic acid, 2-sulphoethyl ester, lithium salt
p-Styrene sulphonic acid, ammonium salt
2-acrylamido-2-methyl-1-propanesulphonic acid, sodium salt p-Styrene sulphonic acid, potassium salt
p-Styrene sulphonic acid
4-4-Ethenylbenzenesulphonic acid, sodium salt,
2-Propenoic acid, 3-sulphopropyl ester, sodium salt
m-Sulphomethylstyrene sulphonic acid, potassium salt
p-Sulphomethylstyrene sulphonic acid, sodium salt
2-Methyl-2-propenoic acid, 3-sulphopropyl ester, sodium salt
2-Methyl-2-propenoic acid, 3-sulphobutyl ester, sodium salt
2-Methyl-2-propenoic acid, 4-sulphobutyl ester, sodium salt
2-Methyl-2-propenoic acid, 2-sulphoethyl ester, sodium salt
2-Methyl-2-[(1-oxo-2-propenyl)amino]-1-propane sulphonic acid
2-Methyl-2-[(1-oxo-2-propenyl)amino]-1-propane sulphonic acid, sodium salt
2-Methyl-2-[(1-oxo-2-propenyl)amino]-1-propane sulphonic acid, potassium salt.

It is preferred, in the preparation of the core-shell latex of the present invention, to use monomers of group C either in combination with monomer(s) of group A or in combination with monomer(s) of group A and B to prepare the shell of the core-shell latex.

Especially preferred vinyl monomers with anionic groups (group C monomers) are 2-propenoic acid sodium salt and 2-acrylamido-2-methyl- 1-propanesulphonic acid, sodium salt Although it is preferred to use monomers of group B to form the core (co)polymer of the core-shell latex according to the present invention, the core (co)polymer may be prepared from a mixture of group B monomers and group C monomers.

Although it is preferred that group C monomers in combination with group A monomers are used to form the shell (co)polymer, it is also possible to form the shell (co)polymer either with a combination of group B monomers with group A monomers or with a combination of group A, B and C monomers.

It has been found that core-shell latices according to the present invention, comprising moieties derived from group A monomers (monomers with a reactive methylene group) in the shell (co)polymer can be added to silver halide photographic materials to serve several purposes. Depending on the Tg of the (co)polymers forming the core and the Tg of the (co)polymers forming the shell, the addition of polymeric latices, according to the present invention, can improve either the dimensional stability of the photographic material or diminish the physical scratchability (increase the scratch resistance) of the material. It was also found that it was possible to improve the dimensional stability of the material and at the same time to diminish the physical scratchability of the photographic material by introducing specific examples of polymeric latices according to the present invention in the photographic material. It was found that adding a polymeric core-shell latex, comprising a reactive methylene group in the shell, according to the present invention, comprising a core (co)polymer with Tg>50° C., preferably with Tg>80° C., and a shell (co)polymer with Tg<30° C., preferably with Tg<0° C., to one or more hydrophilic layers of a silver halide photographic material improved the dimensional stability of the material and at the same time diminished the physical scratchability of the photographic material. When used in a single sided silver halide emulsion material, comprising a support carrying on one side a hydrophilic gelatinous silver halide emulsion layer and on the other side a gelatinous backing layer, it is preferred to use a core-shell latex comprising at least in the shell a (co)polymer with Tg<30° C., preferably with Tg<0° C. In said gelatinous backing layer, the use of a core-shell latex comprising both in the core and in the shell a (co)polymer with Tg<30° C., preferably with Tg<0° C., has also proven to be beneficial.

The Tg of a copolymer can be predicted from the knowledge of the weight fraction (W) of each monomer present in the copolymer and the Tg of the corresponding homopolymers according to the formula:

$$Tg_{copolymer}=W_1(Tg_1)+W_2(Tg_2)+\ldots+W_n \quad (Tg_n),$$

wherein $W_1$ is the weight fraction of the first monomer and $Tg_1$ the Tg of the homopolymer comprising only moieties of the first monomer, $W_2$ is the weight fraction of the second monomer and $Tg_2$ the Tg of the homopolymer comprising only moieties of the second monomer and $W_n$ is the weight fraction of the $n^{th}$ monomer and $Tg_n$ the Tg of the homopolymer comprising only moieties of the $n^{th}$ monomer.

The Tg of both the core copolymer and the shell copolymer of the core-shell latices according to the present invention have been calculated using the formula above. The accuracy of the Tg, calculated as described above is +5° C.

The polymeric latices according to the present invention, do, whatever the Tg of core- or shell-(co)polymers, not increase the water absorption of the photographic material when added to any hydrophilic layer comprised in the photographic material, as do the control latices, not comprising reactive methylene groups.

In the most preferred embodiment the shell (co)polymer comprises always moieties derived from at least one group A monomer, comprising a reactive methylene group. These moieties, derived from a group A monomer, are preferably present in 2 to 50% by weight, most preferably in 2 to 20% by weight, with respect to the total shell (co)polymer.

In the core-shell latices according to the present invention, the core accounts for 1 to 99% by weight of the weight of the entire core-shell particle and the shell for 1 to 99% by weight. Preferably core-shell latices, wherein the shell accounts for 10 to 80% by weight of the weight of the entire core-shell particle, are used according to the present invention.

The core-shell latices according to the present invention can be prepared by an emulsion polymerization technique. In a first step the core is prepared by the emulsion (co)polymerization of one or more polymerizable monomers. It is advantageous that, in this step of the preparation, at least part of said monomer(s) are polymerized in a batch process. The so prepared (co)polymer can then directly be used as core material for the further preparation of the coreshell latex. To control the thickness of the core it is possible to add more of the monomer(s) constituting the core (co)polymer and polymerize these monomers further onto the orginal core prepared during the batch process.

In a second step the monomer(s), needed to form the shell are added to the core material and further polymerized on top of said core material. In this step it is preferred that at least one of the monomers used is an ethylenically unsaturated monomer comprising a reactive methylene ($—CH_2—$) group.

Different techniques for emulsion polymerization and the different ingredients necessary for the reaction (apart from the polymerizable monomer(s)) as e.g. initiators, surface active compounds, reductants, buffer substances etc. can be found in, e.g., Houben Weyl, Methoden der organischen Chemie, IV edition, Band E20, part 1, pages 218 ss, Thieme Verlag 1987.

As initiators are taken into account in general 0.05 to 5% by weight, based on the monomers, of initiators decomposing in radicals. Such initiators are, e.g., organic peroxides, such as lauroyl peroxide, cyclohexanone hydroperoxide, tert.-butyl peroctoate, tert.-butyl perpivalate, tert.-butyl perbenzoate, dichlorobenzoyl peroxide, benzoyl peroxide, di-tert.-butyl peroxide, tert.-butyl hydroperoxide, cumol hydroperoxide, peroxycarbonates such as diisopropyl peroxidicarbonate, dicyclohexyl peroxidicarbonate, diisooctyl peroxidicarbonate, sulphonyl peroxides such as acetylcyclohexylsulphonyl peracetate, sulphonylhydrazides, azo compounds such as azodiisobutyric acid nitril as well as better water-soluble azo compounds as described, e.g., in DE-A-2841045. Inorganic peroxides such as hydrogen peroxide, potassium peroxodisulphate and ammonium peroxodisulphate are suited as well. The initiators decomposing in radicals can be used alone or in combination with reducing agents or heavy metal compounds. Such compounds are, e.g., sodium- or potassium pyrosulphite, formic acid, ascorbic acid, thiourea, hydrazine- or amine derivatives and RONGALIT (1-hydroxymethanesulphinic acid Na-salt). The heavy metal compounds can be present in oil-soluble as well as in water-soluble form. Examples of water-soluble heavy metal compounds are silver nitrate, halides and sulphates of 2- and 3-valent iron, cobalt, nickel and salts of titanium or vanadium in low valency stages. Examples of oil-soluble heavy metal compounds are cobalt naphthenate and the acetylacetone complexes of vanadium, cobalt, titanium, nickel and iron.

The emulsion polymerisations take place at temperatures between 20° and 100° C., preferably between 40° and 85° C.

The amount of emulsifying agents that can be used is 0 to 20%, preferably 1 to 5%, based on the monomers to be polymerised. Anionic as well as non-ionic emulsifying agents are suited therefor. As examples can be mentioned alkyl- and aryl sulphonates such as dodecylsulphonic acid Na-salt, the N-methyl taurinate product with oleic acid (HOSTAPON T) and sulphonated dodecylphenyl phenyl ethers (Dow FAX 2A1), alkyl- and aryl sulphates such as the sodium sulphate of oxethylated nonylphenol (HOSTAPAL B), poly(vinyl alcohol), oxethylated phenols, oleyl alcohol polyglycol ethers, oxethylated polypropylene glycol or natural products such as gelatine and fish glue.

The preparation of core-shell latices has been described in, e.g. S. Lee, A. Rudin, Control of Core-Shell Latex Morphology, Chapter 15, Symposium Series of the American Chemical Society No. 492 "Polymer Latices", page 235 ss, 1992, American Chemical Society, Washington DC.

The type of photographic material in which the polymer latices are incorporated according to the present invention and its field of use is not limited in any way. It includes photographic elements for graphic arts and for so-called amateur and professional black-and-white or colour photography, cinematographic recording and printing materials, X-ray diagnosis, diffusion transfer reversal photographic elements, low-speed and high-speed photographic elements, etc. However the advantages of the present invention become most perspicuous when the latices are incorporated in photographic materials setting high standards to dimensional stability and physical scratchability, e.g. graphic arts contact materials as explained in the Background section. Several types of commercial contact materials are available. Duplicating materials can be of the classical dark room type but in recent times preference is given to so-called daylight or roomlight contact materials which can be handled for a reasonable period under UV-poor ambient light. Also yellow light contact materials exist which can be handled under relative bright yellow light. Very insensitive daylight types are available which have to be exposed by strongly emitting metal-halogen sources. Less insensitive types are designed for exposure by quartz light sources. The daylight materials can be of the negative working type or of the direct positive working type.

Usually in black-and-white materials the silver halide emulsion layer simply consists of just one layer. However double layers and even multiple layer packs are possible. Apart from the emulsion layer a photographic element usually comprises several non-light sensitive layers, e.g. protective layers, backing layers, filter layers and intermediate layers (or "undercoats"). All of these layers can be single, double or multiple. The polymer latices of the present invention can be present in all these layers, or in several of them, or in just one of them. In principle a mixture of two or more different latices can be used, or an invention latex can be mixed with a conventional plasticizer, but for normal practice just one representative of the new types will be sufficient. In a preferred embodiment of a graphic arts contact material the plasticizer (latex) is present in the emulsion layer. The ratio of platicizer to gelatin is in that case comprised between 0.1:1 and 1:1. Preferably the platicizer is present in the gelatinous emulsion layer in an amount between 10 to 75% in weight (% w/w) with respect to the gelatin. When present in the protective layer it is preferred to use the latex in an amount of 10 to 50% in weight (% w/w) with respect to the gelatin present in said protective layer.

Apart from the polymer latex of the present invention the emulsion layer and the other hydrophilic layers can contain, according to their particular design and application, the typical and well-known photographic ingredients such as stabilizers, sensitizers, desensitizers, development accelerators, matting agents, spacing agents, anti-halation dyes, filter dyes, opacifying agents, antistatics, UV-absorbers, surfactants, gelatin hardeners such as formaldehyde and divinylsulphon.

The composition of the silver halide emulsion incorporated in a photographic element of the present invention is not specifically limited and may be any composition selected from e.g. silver chloride, silver bromide, silver iodide, silver chlorobromide, silver bromoiodide, and silver chlorobromoiodide.

The photographic emulsion(s) can be prepared from soluble silver salts and soluble halides according to different methods as described e.g. by P. Glafkidès in "Chimie et Physique Photographique", Paul Montel, Paris (1987), by G. F. Duffin in "Photographic Emulsion Chemistry", The Focal Press, London (1966), and by V. L. Zelikman et al in "Making and Coating Photographic Emulsion", The Focal Press, London (1966).

Two or more types of silver halide emulsions that have been prepared differently can be mixed for forming a photographic emulsion. The average size of the silver halide grains may range from 0.05 to 1.0 μm, preferably from 0.2 to 0.5 μm. For daylight materials the average grain size is preferably comprised between 0.07 μm and 0.20 μm. The size distribution of the silver halide particles can be homodisperse or heterodisperse.

The light-sensitive silver halide emulsions can be chemically sensitized as described e.g. in the above-mentioned "Chimie et Physique Photographique" by P. Glafkidès, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mir Silberhalogeniden" edited by H. Frieser and published by Akademische Verlagsgesellschaft (1968). However in the case of a contact daylight material the emulsion is preferably not chemically ripened and can contain relative high amounts of a desensitizer.

The light-sensitive silver halide emulsions can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. However in the particular case of a contact daylight material the emulsion is preferably not spectrally sensitized in view of the daylight stability.

The silver halide emulsion(s) for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion.

The photographic material of the present invention may further comprise various kinds of surface-active agents in the photographic emulsion layer or in another hydrophilic colloid layer. Suitable surface-active agents include nonionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy-, sulpho-, phospho-, sulphuric- or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration. Preferred surface-active coating agents are compounds containing perfluorinated alkyl groups.

In case of a photographic colour material the typical ingredients like colour forming agents, mask forming agents, Development Inhibitor Releasing couplers, and other Photographic Useful Group releasing couplers can be present.

The support of the photographic material can be a transparent base, preferably an organic resin support, e.g. cellulose nitrate film, cellulose acetate film, polyvinylacetal film, polystyrene film, polyethylene terephthalate film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer. On the other hand the support of the photographic material can be a paper base preferably a polyethylene or polypropylene coated paper base.

The photographic material can be exposed according to its particular composition and application, and processed by any means or any chemicals known in the art depending on its particular application.

The following preparative and photographic examples illustrate the present invention without however being limited thereto.

EXAMPLES

LIST OF ABBREVIATIONS USED TROUGHOUT THE EXAMPLES

AAEMA: 2-acetoacetoxyethylmethacrylate (group A)
BA: 2-propenoic acid n-butylester (group B)
EA: 2-propenoic acid ethyl ester (group B)
MA: 2-propenoic acid methyl ester (group B)
STY: styrene (group B)
MMA: 2-methyl-2-propenoic acid methyl ester (group B)
AMPS: 2-acrylamido-2-methyl-1-propanesulphonic acid (group C)

Th Tg of the core copolymers and the shell copolymers of the latices in all examples has been calculated, as described above, from the knowledge of the weight fraction (W) of each monomer present in the copolymer and the Tg of the corresponding homopolymers according to the formula:

$$Tg_{copolymer}=Wi(Tg_1)+W_2(Tg_2)+\ldots+W_n \qquad (Tg_n),$$

wherein $W_1$ is the weight fraction of the first monomer and $Tg_1$ the Tg of the homopolymer comprising only moieties of the first monomer, $W_2$ is the weight fraction of the second monomer and $Tg_2$ the Tg of the homopolymer comprising only moieties of the second monomer and $W_n$ is the weight fraction of the $n^{th}$ monomer and $Tg_n$ the Tg of the homopolymer comprising only moieties of the $n^{th}$ monomer. The values for the (co)polymers making up the core and the shell of the core-shell latices according to this invention, are reported in table 2.

PREPARATION EXAMPLE 1 (LAT1).

The following solutions were prepared:

A: Monomer forming the core:
72 g MMA

B: Shell preemulsion:
44 ml demineralised water
36 ml of a 10% aqueous solution of HOSTAPON T (tradename of Hoechs AG, Germany for N-methyl taurinate of oleic acid)
18 g AMPS in 90 ml demineralized water at pH 8.0
25.2 g AAEMA
244.8 g MMA C: Initiator
C1: 18 ml 2% $K_2S_2O_8$ solution
C2: 54 ml 2% $K_2S_2O_8$ solution and 6 ml HOH
C3: 18 ml 2% $K_2S_2O_8$ solution 531 ml demineralized water were mixed with 72 ml of a 10% aqueous solution of HOSTAPON T (tradename of Hoechs AG, Germany for N-methyl taurinate of oleic acid), stirred at 250 rpm, rinsed with $N_2$ and heated to 83° C. Solution A was added and after 5 minutes solution C1 was added. 1 minute after this addition, both C2 and B were added to the reaction mixture, C2 was added at 2 ml/min and B at 28.4 ml/min.

After completion of the addition of B and C2 the mixture was stirred for another 15 minutes at 83° C., then solution C3 was added and the reaction mixture was further stirred at 95° C. for 30 minutes.

Under a low vacuum, 120 ml of the solvents were evaporated over 60 minutes, and 150 ml demineralized water were added. After cooling the latex was filtered. The pH was adjusted to 5.7.

Yield: 1535 g latex, with a concentration of 23% by weight. Average particle size: 86 nm.

PREPARATION EXAMPLE 2 (LAT2).

The following solutions were prepared:

A: Monomer forming the core:
36 g MMA

B: Shell preemulsion :
220.5 ml demineralised water
18 ml of a 10% aqueous solution of
HOSTAPON T (tradename of Hoechs AG, Germany for N-methyl taurinate of oleic acid)
9 g AMPS in 45 ml demineralized water at pH 8.0
25.2 g AAEMA
109.8 g MMA C: Initiator C1:
9 ml 2% $K_2S_2O_8$ solution
C2: 27 ml 2% $K_2S_2O_8$ solution and 3 ml HOH
C3: 9 ml 2% $K_2S_2O_8$ solution 265.5 ml demineralized water were mixed with 36 ml of a 10% aqueous solution of HOSTAPON T (tradename of Hoechs AG, Germany for N-methyl taurinate of oleic acid), stirred at 250 rpm, rinsed with $N_2$ and heated to 83° C. Solution A was added and after 5 minutes solution C1 was added. 1 minute after this addition, both C2 and B were added to the reaction mixture, C2 was added at 1 ml/min and B at 14.2 ml/min.

After completion of the addition of B and C2 the mixture was stirred for another 15 minutes at 83° C., then solution C3 was added and the reaction mixture was further stirred at 95° C. for 30 minutes.

Under a low vacuum, 80 ml of the solvents were evaporated over minutes. After cooling the latex was filtered. The pH was adjusted to 5.8.

Yield: 755 g latex, with a concentration of 24.5% by weight. Average particle size: 83 nm.

PREPARATION EXAMPLE 3 (LAT3).

The following solutions were prepared:

A1: Monomer forming the core:
72 g MMA

A2: Core preemulsion
252 g MMA
385 ml demineralized HOH
31.5 ml of a 10% aqueous solution of HOSTAPAL B (tradename of Hoechst AG, Germany for the sodium sulphate of oxethylated nonylphenol)

B: Shell preemulsion:
56 ml demineralised water
4.5 ml of a 10% aqueous solution of HOSTAPAL B (tradename of Hoechst AG, Germany for the sodium sulphate of oxethylated nonylphenol)
3.6 g AMPS in 18 ml demineralized water at pH 8.0
3.6 g AAEMA
28.8 g EA C: Initiator C1:
C1: 18 ml 2% $K_2S_2O_8$ solution
C2: 54 ml 2% $K_2S_2O_8$ solution and 6 ml HOH
C3: 18 ml 2% $K_2S_2O_8$ solution 531 ml demineralized water were mixed with 72 ml of a 10% aqueous solution of HOSTAPAL B (tradename of Hoechs AG, Germany for the sodium sulphate of oxethylated nonylphenol), stirred at 250 rpm, rinsed with $N_2$ and heated to 83° C. Solution A1 was added and after minutes solution C1 was added. 1 minute after this addition, both C2 and A2 were added to the reaction mixture, C2 was added at 2 ml/min and A2 at 26.6 ml/min. After completion of the addition of A2, B was added to the reaction mixture at 26.6 ml/min.

After completion of the addition of B the mixture was stirred for another 15 minutes at 83° C., then solution C3 was added and the reaction mixture was further stirred at 95° C. for 30 minutes.

Under a low vacuum, 120 ml of the solvents were evaporated over minutes, and 120 ml demineralized water were added. After cooling the latex was filtered. The pH was adjusted to 5.6.

Yield: 1524 g latex, with a concentration of 24.6% by weight. Average particle size: 78 nm.

PREPARATION EXAMPLE 4 (LAT4).

The following solutions were prepared:

A1: Monomer forming the core:
72 g STY

A2: Core preemulsion
252 g STY
385 ml demineralized HOH
31.5 ml of a 10% aqueous solution of HOSTAPAL B (tradename of Hoechst AG, Germany for the sodium sulphate of oxethylated nonylphenol)

B: Shell preemulsion:
56 ml demineralised water
4.5 ml of a 10% aqueous solution of HOSTAPAL B (tradename of Hoechs AG, Germany for the sodium sulphate of oxethylated nonylphenol)
13.6 g AMPS in 18 ml demineralized water at pH 8.0
3.6 g AAEMA
28.8 g MA C: Initiator C1:
C1: 18 ml 2% $K_2S_2O_8$ solution
C2: 54 ml 2% $K_2S_2O_8$ solution and 6 ml HOH
C3: 18 ml 2% $K_2S_2O_8$ solution 531 ml demineralized water were mixed with 72 ml of a 10% aqueous solution of HOSTAPAL B (tradename of Hoechs AG, Germany for the sodium sulphate of oxethylated nonylphenol), stirred at 250 rpm, rinsed with $N_2$ and heated to 83° C. Solution A1 was added and after 5 minutes solution C1 was added. 1 minute after this addition, both C2 and A2 were added to the reaction mixture, C2 was added at 2 ml/min and A2 at 26.9 ml/min. After completion of the addition of A2, B was added to the reaction mixture at 26.9 ml/min.

After completion of the additions the mixture was stirred for another 15 minutes at 83° C., then solution C3 was added and the reaction mixture was further stirred at 95° C. for 30 minutes.

Under a low vacuum, 100 ml of the solvents were evaporated over 60 minutes, and 100 ml demineralized water were added. After cooling the latex was filtered. The pH was adjusted to 5.7 and 72 ml of a 10% aqueous solution of HOSTAPAL B (tradename of Hoechst AG, Germany for the sodium sulphate of oxethylated nonylphenol) were added.

Yield: 1429 g latex, with a concentration of 25.5% by weight. Average particle size: 78 nm.

PREPARATION EXAMPLE 5 (LAT5).

The following solutions were prepared:

A: Monomer forming the core:
72 g BA

B: Shell preemulsion:
441 ml demineralised water
36 ml of a 10% aqueous solution of HOSTAPON T (tradename of Hoechs AG, Germany for N-methyl taurinate of oleic acid)
12 g AMPS in 90 ml demineralized water at pH 7.5
25.2 g AAEMA
244.8 g BA C: Initiator C1:
C1; 18 ml 2% $K_2S_2O_8$ solution
C2: 54 ml 2% $K_2S_2O_8$ solution and 6 ml HOH
C3: 18 ml 2% $K_2S_2O_8$ solution 531 ml demineralized water were mixed with 72 ml of a 10% aqueous solution of HOSTAPON T (tradename of Hoechs AG, Germany for N-methyl taurinate of oleic acid), stirred at 250 nm, rinsed with $N_2$ and heated to 83° C. Solution A was added and after 5 minutes solution C1 was added. 2 minutes after this addition, both C2 and B were added to the reaction mixture, C2 was added at 2 ml/min and B at 28.8 ml/min.

After completion of the addition of B and C2 the mixture was stirred for another 15 minutes at 83° C., then solution C3 was added and the reaction mixture was further stirred at 95° C. for 30 minutes.

Under a low vacuum, 130 ml of the solvents were evaporated over 60 minutes. After cooling the latex was filtered. The pH was adjusted to 5.6.

Yield: 1598 g latex, with a concentration of 23.4% by weight. Average particle size: 77 nm.

PREPARATION EXAMPLE 6 (LAT6).

The following solutions were prepared:

A: Monomer forming the core:
72 g BA

B: Shell preemulsion:
441 ml demineralised water
36 ml of a 10% aqueous solution of HOSTAPON T (tradename of Hoechs AG, Germany for N-methyl taurinate of oleic acid)
12 g AMPS in 90 ml demineralized water at pH 7.5
10.8 g AAEMA
259.2 g BA C: Initiator C1:
C1: 18 ml 2% $K_2S_2O_8$ solution
C2: 54 ml 2% $K_2S_2O_8$ solution and 6 ml HOH
C3: 18 ml 2% $K_2S_2O_8$ solution 531 ml demineralized water were mixed with 72 ml of a 10% aqueous solution of HOSTAPON T (tradename of Hoechs AG, Germany for N-methyl taurinate of oleic acid), stirred at 250 rpm, rinsed with $N_2$ and heated to 83° C. Solution A was added and after 5 minutes solution C1 was added. 2 minutes after this addition, both C2 and B were added to the reaction mixture, C2 was added at 2 ml/min and B at 28.9 ml/min.

After completion of the addition of B and C2 the mixture was stirred for another 15 minutes at 83° C., then solution C3 was added and the reaction mixture was further stirred at 95° C. for 30 minutes.

Under a low vacuum, 180 ml of the solvents were evaporated over 60 minutes, and 180 ml demineralized water were added. After cooling the latex was filtered. The pH was adjusted to 5.5.

Yield: 1613 g latex, with a concentration of 23.3% by weight. Average particle size: 73 nm.

PREPARATION EXAMPLE 7 (LAT7).

The following solutions were prepared:

A: Monomer forming the core:
72 g BA

B: Shell preemulsion:
441 ml demineralised water
36 ml of a 10% aqueous solution of HOSTAPON T (tradename of Hoechs AG, Germany for N-methyl taurinate of oleic acid)
18 g AMPS in 90 ml demineralized water at pH 7.5
25.2 g AAEMA
226.8 g BA
18 g STY C: Initiator C1:
C1: 18 ml 2% $K_2S_2O_8$ solution
C2: 54 ml 2% $K_2S_2O_8$ solution and 6 ml HOH
C3: 18 ml 2% $K_2S_2O_8$ solution 531 ml demineralized water were mixed with 72 ml of a 10% aqueous solution of HOSTAPON T (tradename of Hoechs AG, Germany for N-methyl taurinate of oleic acid), stirred at 250 rpm, rinsed with $N_2$ and heated to 83° C. Solution A was added and after 5 minutes solution C1 was added. 2 minutes after this addition, both C2 and B were added to the reaction mixture, C2 was added at 2 ml/min and B at 28.8 ml/min.

After completion of the addition of B and C2 the mixture was stirred for another 15 minutes at 83° C., then solution C3 was added and the reaction mixture was further stirred at 95° C. for 30 minutes.

Under a low vacuum, 170 ml of the solvents were evaporated over 60 minutes, and 170 ml demineralized water were added. After cooling the latex was filtered. The pH was adjusted to 5.7.

Yield: 1629 g latex, with a concentration of 24.0% by weight. Average particle size: 69 nm.

PREPARATION EXAMPLE 8 (LAT8).

The following solutions were prepared:

A1: Core preemulsion 1:
100 g STY
1 g AAEMA
51 ml of a 10% aqueous solution of HOSTAPAL B (tradename of Hoechst AG, Germany for the sodium sulphate of oxethylated nonylphenol)
169 ml HOH A2: Core preemulsion 2:
350 g STY
542 ml demineralized HOH
43.4 ml of a 10% aqueous solution of HOSTAPAL B (tradename of Hoechst AG, Germany for the sodium sulphate of oxethylated nonylphenol)
3.5 g AAEMA B: Shell preemulsion:

70 ml demineralised water 5.6 ml of a 10% aqueous solution of HOSTAPAL B (tradename of Hoechs AG, Germany for the sodium sulphate of oxethylated nonylphenol)

5 g AMPS in 25 ml demineralized water at pH 8.0

0.5 g AAEMA 40 g EA

C: Initiator C1:

C1: 25 ml 2% $K_2S_2O_8$ solution

C2: 75 ml 2% $K_2S_2O_8$ solution and 15 ml HOH

C3: 25 ml 2% $K_2S_2O_8$ solution 531 ml demineralized water were mixed with 50 ml of a 10% aqueous solution of HOSTAPAL B (tradename of Hoechs AG, Germany for the sodium sulphate of oxethylated nonylphenol), stirred at 250 rpm, rinsed with $N_2$ and heated to 83 ° C. Solution A1 was added and after minutes solution C1 was added. 1 minute after this addition, both C2 and A2 were added to the reaction mixture, C2 was added at 3 ml/min and A2 at 37.3 ml/min. After completion of the addition of A2, B was added to the reaction mixture at 26.9 ml/min.

After completion of the additions the mixture was stirred for another 15 minutes at 83° C., then solution C3 was added and the reaction mixture was further stirred at 95° C for 30 minutes.

Under a low vacuum, 130 ml of the solvents were evaporated over 60 minutes. After cooling the latex was filtered. The pH was adjusted to 5.5. As post-stabilizer 203 ml of a 10% aqueous solution of HOSTAPAL B (tradename of Hoechs AG, Germany for the sodium sulphate of oxethylated nonylphenol) were added.

Yield: 1948 g latex, with a concentration of 26.0% by weight. Average particle size: 91 nm.

A summary of the compositions in % by weight of the invention and comparative core-shell latices is given in table 1.

TABLE 1

| | CORE | | | | SHELL | | | | | | |
|---|---|---|---|---|---|---|---|---|---|---|---|
| Nr | MMA | BA | STY | AAEMA | AAEMA | MMA | EA | MA | BA | AMPS | STY |
| LAT1 | 20 | | | | 7 | 68 | | | | 5 | |
| LAT2 | 20 | | | | 14 | 61 | | | | 5 | |
| LAT3 | 90 | | | | 1 | | 8 | | | 1 | |
| LAT4 | | | 90 | | 1 | | | 8 | | 1 | |
| LAT5 | | 20 | | | 7 | | | | 68 | 5 | |
| LAT6 | | 20 | | | 3 | | | | 72 | 5 | |
| LAT7 | | 20 | | | 7 | | | | 63 | 5 | 5 |
| LAT8 | | | 89.1 | 0.9 | 0.1 | | 8.8 | | | 1.1 | |

TABLE 2

| Number of the Latex | Calculated Tg of the core copolymer in °C. | Calculated Tg of the shell copolymer in °C. |
|---|---|---|
| LAT1 | 105 | 100 |
| LAT2 | 105 | 90 |
| LAT3 | 105 | −2 |
| LAT4 | 100 | 24 |
| LAT5 | −54 | −35 |
| LAT6 | −54 | −38 |
| LAT7 | −54 | −26 |
| LAT8 | 100 | −29 |

PHOTOGRAPHIC EXAMPLE 1

In this example the dimensional stability and water absorption is compared of photographic material samples comprising no plasticizer, a control plasticizer polyethylacrylate (C-1), invention latices LAT5, LAT6 and LAT7.

The photographic material was prepared as follows. A direct positive pure silver bromide emulsion was precipitated by a double jet technique and internally sensitized. The emulsion was then externally fogged using thiourea dioxide as to obtain the desired sensitivity. Finally the emulsion was divided in aliquot portions and different latices were added to each portion, such as to have 50 % in weight of latex polymer with respect to the gelatin present in the portions of the emulsion.

The coating solutions thus prepared were applied to a subbed, 100 μm thick, polyethylene terephtalate base at a silver coverage, expressed as silver nitrate, of 3.18 g/m$^2$ and a gelatin coverage of 2.7 g/m$^2$. A protective layer was applied containing gelatin hardened with formaldehyde at a coverage of 0.7 g/m$^2$.

The dimensional change during processing is evaluated as follows. Each coated sample was conditioned in an acclimated room for at least 6 hours to a relative humidity of 30% at 22° C. Two holes with a diameter of 5 mm were punched at a distance of 200 mm in each film sample having dimensions of 35 mm×296 mm. The exact interval between those holes was measured with an inductive half-bridge probe (TESA FMS100) having an accuracy of 1 μm, whereby this distance was called X μm. Subsequently the film material was subjected to processing in an automatic apparatus, a PAKO 26RA the dryer of which was equipped with an air-inlet. The samples were developed at 38° C., fixed at 33° C., rinsed without temperature control, and dried, whereby air of 22° C. and of 30% RH was provided through the air-inlet and wherby the temperature was raised up to 55° C. The distance between the two holes in the film is measured again after an acclimatisation period of 3 hours and is expressed as Y μm. The dimensional stability is calculated as (Y-X).5 and expressed in μm/m.

The water absorption was measured gravimetrically. A dry sample of the material was accurately weighted (W1) and the without exposure processed as described above, but taken out of the processing apparatus before the dryer. The processed, but not dried sample of the material was weighted again (W2) and after drying the sample was weighted again (W3). The difference between W2 and W3 was the water absorption of the sample, i.e. the amount of water per m$^2$ that has to be evaporated in the dryer. The results are summarized in table 3.

TABLE 3

| Plasticizer 50% in weight vs gelatin | Waterabsorption in g/m$^2$ | Dimensional stability in μm/m |
|---|---|---|
| No plasticizer | 4.7 | 157 |
| Polyethylacrylate (control) | 6.0 | 100 |
| LAT5 | 5.2 | 105 |
| LAT6 | 5.4 | 110 |
| LAT7 | 4.9 | 90 |

It is clear that the addition of the invention latices makes it possible to have a photographic material that combines the low water absorption of a material without plasticizer with the dimensional stability of a material comprising the control plasticizer.

PHOTOGRAPHIC EXAMPLE 2

In this example the water absorption, dimensional stability and physical scratchability is compared of photographic material samples comprising no plasticizer, a control plasticizer polyethylacrylate (C-1), a core-shell latex with only 1% by weight of moieties comprising reactive methylene groups with respect to the total weight of the monomers present in both core and shell. In the LAT8 the shell (co)polymer comprised only 1% by weight (with respect to the total weight all monomers used to form said shell copolymer) of an unsaturated monomer comprising a reactive —$CH_2$—group. Latices LAT3, LAT4 comprised 10% by weight (with respect to the total weight all monomers used to form said shell copolymer) of an unsaturated monomer comprising a reactive —$CH_2$—group.

The photographic material was prepared as described in photographic example 1.

Dimensional stability and water absorption were measured as described above (see photographic example 1), and physical scratchability was measured as follows: The photographic material is exposed so as to give after development in a metol-hydroquinone developer (G101, a tradename for a developer from Agfa-Gevaert NV Mortsel, Belgium) at 38° C. maximum density. The processing was carried out in an automatic apparatus, a PAKO 26RA the dryer of which was equipped with an air-inlet. The samples were developed at 38° C., fixed at 33° C., rinsed without temperature control, and dried, whereby air of 22° C. and of 30% RH was provided through the air-inlet and whereby the temperature was raised up to 55° C. The developed and dried material was passed under a stylus with a diamond ball shaped end with diameter 5 μm. The stylus was loaded with weights between 1 to 30 g with increments of 1 g each step going from 1 to 30 g. When the photographic material is passed under the stylus, some of the emulsion was scratched away and thus the density of the scratch was lowered. The light transmittance under scratch was measured for each increment of 1 g and correlated to the weight imposed on the stylus. The weight where the correlation line of transmittance versus weight crosses the weight axis is taken as a measure for physical scratchability and is expressed in g. The greater the figure, the lower the scratchability. The results are to be found in table 4

TABLE 4

| Plasticizer 50% in weight vs gelatin | Water-absorption in g/m$^2$ | Dimensional stability in μm/m | Scratchability in g |
|---|---|---|---|
| No plasticizer | 4.7 | 157 | 9.0 |
| Polyethylacrylate (control) | 6.0 | 100 | 7.9 |
| LAT8 | 5.9 | 104 | 8.3 |
| LAT3 | 5.2 | 85 | 10.2 |
| LAT4 | 5.3 | 101 | 9.3 |

It is clear that the use of invention latices in a photographic material, instead of a control latex, improves the dimensional stability to the same extent as the use of a control latex, but improves the scratchability of the materials with respect to the material comprising the control latex. The invention latex with only 1% of reactive methylene groups in the shell (LAT8) is less effective than the invention latices comprising more than 1% of reactive methylene groups in the shell.

PHOTOGRAPHIC EXAMPLE 3

In this example the water absorption and physical scratchability is compared of photographic material samples comprising no plasticizer, a control plasticizer polyethylacrylate (C-1), invention latices LAT1, LAT2.

The photographic material was a negative working material, prepared as follows : A cubic silver halide emulsion, comprising 0.4 of iodide, 16% of bromide and 83.4% of chloride was prepared by a double jet emulsion technique, and doped with Ir and Rh. The average crystal diameter was 0.30 μm. To 1 kg of the gold-sulfer sensitized emulsion, containing 1.1 mole of silver halide was added a conventional substituted tetraazaindene and a conventionally substituted mercaptotetrazole. A blue spectral sensitizer was added.

The coating solutions thus prepared were applied to a subbed, 175 μm thick, polyethylene terephthalate base at a silver coverage, expressed as silver nitrate, of 7.45 g/m$^2$ and a gelatin coverage of 3.35 g/m$^2$. A protective layer was applied containing gelatin hardened with formaldehyde at a coverage of 0.93 g/m$^2$. Between the emulsion layer and the protective layer an intermediate layer was applied with a gelatin coverage of 1 g/m$^2$.

Before coating the coating solution for the intermediate layer was divided in 5 aliquot portions. To the first portion no latex was added, to the second portion a control latex (polyethylacrylate) was added, to the third and the fourth portion invention latex LAT1 and LAT2 were added respectively. All latices were added in an amount of 50% by weight with respect to the gelatin. The results are summarized in table 5.

TABLE 5

| Plasticizer 50% in weight vs gelatin | Waterabsorption in g/m$^2$ | Scratchability in g |
|---|---|---|
| No plasticizer | 6.9 | 8.4 |
| polyethylacrylate (control) | 11.8 | 10.5 |
| LAT1 | 6.5 | 11.0 |
| LAT2 | 6.3 | 11.0 |

The addition of invention latices to the photographic material provides a material with better scratch resistance (lower scratchability) combined with lower water absorption.

PHOTOGRAPHIC EXAMPLE 4

In this example the water absorption and physical scratchability is compared of photographic material samples comprising no plasticizer, invention latices LAT1 and invention latex LAT2.

The photographic material was the same material as described in photographic example 3, but now the latices were added to the protective layer. Before coating the coating solution for the protective layer was divided in 4 aliquot portions. To the first portion no latex was added, to the second and to the third portion invention latex LAT1 and LAT2 were added respectively. All latices were added in an amount of 35% by weight with respect to the gelatin. The results are summarized in table 6.

TABLE 6

| Plasticizer 35% in weight vs gelatin | Waterabsorption in g/m$^2$ | Scratchability in g |
|---|---|---|
| No plasticizer | 6.0 | 8.4 |
| LAT1 | 6.2 | 9.0 |
| LAT2 | 5.8 | 9.1 |

PHOTOGRAPHIC EXAMPLE 5

In this example the water absorption, dimensional stability and physical scratchability is compared of photographic material samples comprising no plasticizer, invention latices LAT3 cand LAT4.

The photographic material was the same material as described in photographic example 3. The latices were added to the protective layer. Therefore the coating solution of the protective layer was divided in 4 alaquot portions. To the first portion no latex was added, to the second and the third portion invention latex LAT3 and LAT4 were added respectively. All latices were added in an amount of 35% by weight with respect to the gelatin comprised in the coating solution of the protective coating. The results are summarized in table 7.

TABLE 7

| Plasticizer 35% in weight vs gelatin | Water-absorption in g/m$^2$ | Dimensional stability in μm/m | Scratchability in g |
|---|---|---|---|
| No plasticizer | 6.0 | 64 | 8.4 |
| LAT3 | 6.0 | 54 | 10.0 |
| LAT4 | 6.0 | 62 | 10.5 |

When added to the protective layer of a photographic material, the invention latices provide a material with equal water absorption and dimensional stability, but with a largely improved scratchability (higher scratch resistance).

PHOTOGRAPHIC EXAMPLE 6

In this example the water absorption, dimensional stability and physical scratchability is compared of photographic material samples comprising no plasticizer, invention latices LAT3 and LAT4.

The photographic material was the same material as described in photographic example 3. The latices were added to the intermediate layer. Therefore the coating solution of the intermediate layer was divided in 4 alaquot portions. To the first portion no latex was added, to the second portion and the third portion invention latex LAT3 and LAT4 were added respectively. All latices were added in an amount of 50% by weight with respect to the gelatin comprised in the coating solution of the intermediate layer. The results are summarized in table 8.

TABLE 8

| Plasticizer 50% in weight vs gelatin | Water absorption in g/m$^2$ | Dimensional stability in μm/m | Scratchability in g |
|---|---|---|---|
| No plasticizer | 6.2 | 66 | 8.5 |
| LAT3 | 5.9 | 50 | 9.2 |
| LAT4 | 5.8 | 59 | 9.3 |

PHOTOGRAPHIC EXAMPLE 7

On one side of double sided a subbed 100 μm thick polyethylenterehpthalate film a gelatinous backing layer was coated such as to have 1.54 g of gelatin/m$^2$. To the coating solution, various latices were added in an amount to have 1 g of a 30% dispersion of said latex per m$^2$. The various latices added to the various coating solutions were: polyethylacrylate as control, LAT1, LAT3 and LAT5. After coating and drying, the point defects were in the coated backing layers were counted in 30 m$^2$ of material and normalized to a number (#)/100 m$^2$. It resulted that the backing layers comprising a latex with a soft (i.e. having low Tg) shell showed no point defects, whereas the comparative latex and an invention latex with both a hard (i.e. having a high Tg) shell and hard core showed many point defects. The results are summarized in table 9.

TABLE 9

| Latex | Tg of the core °C. | Tg of the shell °C. | Point defects #/100 m$^2$ |
|---|---|---|---|
| Polyethylacrylate (control) | no core-shell latex Tg = −24° C. | | 63 |
| LAT1 | 105 | 100 | 40 |
| LAT3 | 105 | −2 | 0 |
| LAT5 | −54 | −35 | 0 |

We claim:

1. A photographic material comprising a support, a subbing layer, at least one hydrophilic gelatinous silver halide emulsion layer, optionally one or more non-silver halide containing hydrophilic gelatinous layer(s) and a core-shell latex polymer, comprising a core (co)polymer and a shell (co)polymer characterized in that (i) said core-shell latex is present in at least one of said hydrophilic gelatinous layers, (ii) said shell (co)polymer comprises moieties A derived from at least one ethylenically unsaturated monomer having a reactive methylene group and (iii) said moieties A present in said shell (co)polymer make up between 1 and 30% by weight of all moieties present in both said core and said shell (co)polymer and (iv) said moieties A present in said shell (co)polymer make up between 2 and 50% of all moieties present in said shell (co)polymer.

2. A photographic material according to claim 1, wherein said moieties A present in said shell (co)polymer make up between 1 and 15% by weight of all moieties present in both said core and said shell (co)polymer and said moieties A present in said shell (co)polymer make up between 2 and 20% of all moieties present in said shell (co)polymer.

3. A photographic material according to claim 1, wherein said ethylenically unsaturated monomer comprising a reactive —$CH_2$— group is a member selected from the group consisting of 2-acetoacetoxyethylacrylate; 2-cyano-N-2-propenylacetamide; 5-hexene-2,4-dione; 5-methyl-5-hexene-2,4-dione; 2-methyl-2-propenoic acid; 2-[(cyanoacetyl)-oxy]ethyl ester; 2-acetoacetoxy- 2,2-dimethylpropyl methacrylate; 3-oxo-4-pentenoic acid, ethyl ester; 3-oxo-butanoic acid, 2-[(2-methyl-1-oxo-2-propenyl)oxy]ethyl ester and 2-acetoacetoxyethylmethacrylate.

4. A photographic material according to claim 1, wherein said core-shell latex is only present in one of said hydrophilic gelatinous non-silver halide layers.

5. A photographic material according to claim 1, wherein said core-shell latex is present is said emulsion layer.

6. A photographic material according to claim 1, wherein a gelatinous protective layer is present and said core-shell latex is present is said protective layer.

7. A photographic material according to claim 1, wherein a gelatinous intermediate layer is present and said core-shell latex is present is said intermediate layer.

8. A photographic material according to claim 1, wherein on the side of said support, opposite to said hydrophilic gelatinous silver halide emulsion layer, a backing layer is present and said core-shell latex is present in said backing layer.

9. A photographic material according to claim 1, wherein said core (co)polymer has a Tg>50° C. and said shell (co)polymer has a Tg<30° C.

10. A photographic material according to claim 1, wherein said core (co)polymer has a Tg>80° C. and said shell (co)polymer has a Tg<0° C.

11. A photographic material to claim 1, wherein said core-shell latex comprises in the core as well as in the shell a (co)polymer with Tg<30° C.

12. A photographic material according to claim 1, wherein said core-shell latex is present in at least one hydrophilic gelatinous layer and that the ratio of said core-shell latex to the gelatin contained in said layer is comprised between 0.1:1 to 1:1.

* * * * *